US010144998B2

(12) United States Patent
Lequeu et al.

(10) Patent No.: US 10,144,998 B2
(45) Date of Patent: Dec. 4, 2018

(54) METHOD OF MAKING A STRUCTURAL ELEMENT FOR AERONAUTICAL CONSTRUCTION COMPRISING DIFFERENTIAL WORK-HARDENING

(75) Inventors: Philippe Lequeu, Veyre-Monton (FR); Fabrice Heymes, Veyre-Monton (FR); Armelle Danielou, Les Echelles (FR)

(73) Assignee: CONSTELLIUM ISSOIRE, Issoire (FR)

( * ) Notice: Subject to any disclaimer, the term of this patent is extended or adjusted under 35 U.S.C. 154(b) by 1003 days.

(21) Appl. No.: 11/734,843

(22) Filed: Apr. 13, 2007

(65) Prior Publication Data

US 2007/0246137 A1 Oct. 25, 2007

Related U.S. Application Data

(60) Provisional application No. 60/803,553, filed on May 31, 2006.

(30) Foreign Application Priority Data

Apr. 21, 2006 (FR) ..... 06 03567

(51) Int. Cl.

| | |
|---|---|
| ***C22C 21/12*** | (2006.01) |
| ***C22F 1/057*** | (2006.01) |
| ***C22C 21/14*** | (2006.01) |
| ***C22C 21/16*** | (2006.01) |
| ***C22C 21/18*** | (2006.01) |
| ***C22F 1/04*** | (2006.01) |

(52) U.S. Cl.

CPC ..... *C22F 1/057* (2013.01); *C22C 21/12* (2013.01); *C22C 21/14* (2013.01); *C22C 21/16* (2013.01); *C22C 21/18* (2013.01); *C22F 1/04* (2013.01); *B21B 2205/02* (2013.01)

(58) Field of Classification Search

CPC ..... C22C 21/12; C22C 21/14; C22C 21/16; C22C 21/18; C22F 1/057; C22F 1/04

USPC ..... 148/693, 416

See application file for complete search history.

(56) References Cited

U.S. PATENT DOCUMENTS

| | | | |
|---|---|---|---|
| 5,496,426 | A | 3/1996 | Murtha |
| 2003/0226935 | A1 | 12/2003 | Garratt et al. |
| 2005/0028899 | A1 | 2/2005 | Igumenov et al. |
| 2006/0011272 | A1* | 1/2006 | Lin et al. ..... 148/439 |

FOREIGN PATENT DOCUMENTS

| | | |
|---|---|---|
| EP | 0062469 | 10/1982 |
| JP | 5941434 | 3/1984 |
| RU | 1788078 | 1/1993 |
| RU | 2184174 | 6/2002 |
| WO | 9858759 | 12/1998 |
| WO | 2005098072 | 10/2005 |

OTHER PUBLICATIONS

Machine translation of WO 2005098072.*
International Search Report, FR0603567, dated Oct. 30, 2006.

* cited by examiner

*Primary Examiner* — Edward M Johnson
(74) *Attorney, Agent, or Firm* — McBee Moore Woodward & Vanik IP, LLC; Susan E. Shaw McBee; David Vanik

(57) ABSTRACT

A process for fabricating a worked product or a monolithic multi-functional structural element comprising aluminium alloy includes a hot working step and at least one transformation step by cold plastic deformation after the hot transformation step. At least two zones of the structural element have imposed generalized average plastic deformations and the imposed deformations are different by at least 2%. Structural elements can be fabricated, particularly for aeronautical construction, with properties that are variable while their geometric characteristics are identical to those of existing components. The process is economic and controllable, and properties can be varied for parts not requiring any artificial ageing.

19 Claims, 5 Drawing Sheets

METHOD OF MAKING A STRUCTURAL ELEMENT FOR AERONAUTICAL CONSTRUCTION COMPRISING DIFFERENTIAL WORK-HARDENING

FIELD OF THE INVENTION

This invention relates to worked products and structural components made of aluminium alloy, particularly for aeronautical construction.

BACKGROUND OF THE INVENTION

Monolithic metallic structural elements having variable properties within the elements are very much in demand in the aeronautical industry. Structural elements are subjected to a wide variety of contradictory constraints that require particular choices about materials and working conditions. Such choices can lead to unsatisfactory compromises. Furthermore, replacement of long and expensive mechanical assembly steps by more economic integral machining steps of monolithic components is limited by the ability to obtain the most advantageous properties in each geometric zone of a monolithic element. Therefore it would be very useful to make monolithic structural elements having variable properties within the elements to obtain an optimum compromise of properties in each zone while benefiting from the economic advantages of integral machining processes. However, no process for manufacturing a monolithic metallic structural element with variable properties within the element has been industrialized due to cost and reliability problems.

Thus, several methods have been proposed in the prior art to make monolithic metallic structural elements with variable properties within each element.

A first proposed solution uses different heat treatments between the ends of the structural element at the time of artificial ageing.

FR 2 707 092 (Pechiney Rhenalu) describes a method of making structural work-hardened products with various continuously variable properties in at least one direction. This document achieves artificial ageing at a temperature T at one end and a temperature t at the other end in a special furnace comprising a hot chamber and a cold chamber connected through a heat pump.

WO 2005/098072 (Pechiney Rhenalu) describes a fabrication process in which at least one artificial ageing treatment step is carried out in a furnace with a controlled thermal profile comprising at least two zones or groups of zones $Z_1$ and $Z_2$ with initial temperatures $T_1$ and $T_2$ in which the length of the two zones is at least one meter.

These processes limit variations of properties to properties that can be modified compatibly during artificial ageing. These types of processes cannot be used for alloys without heat treatment. Similarly, for alloys in the 2XXX family for which many parts are sold in the T3 or T4 temper (not annealed), it is impossible to obtain elements with variable properties using this process.

US patent application 2003/226935 describes having a microstructure with increased amounts of fiber texture in a given plane perpendicular to the length an intra-rib area in order to reduce the rate of fatigue crack growth.

Another approach proposes to weld two parts made of different alloys before machining the resulting part. Although the material of the structural element obtained is continuous and its properties are variable within the element, it is not a monolithic structural element due to the welded zone.

PCT application WO 98/58759 (British Aerospace) describes a hybrid billet formed from a 2000 alloy and a 7000 alloy by friction-stir welding, from which a spar is machined. Patent application EP 1 547 720 A1 (Airbus UK) describes an assembly method by welding two parts typically obtained from different alloys to make a single structural part after machining for aeronautical applications such as a spar.

The problem is partly solved in the aeronautical industry by making local variations in the thickness of structural elements with homogenous properties within the elements so that they can resist local stresses. The thickness variation is usually obtained by assembly or by machining.

For example, CA 2 317 366 (Airbus Deutschland) describes the fabrication of fuselage elements by welding plates of different thicknesses. It would also be possible to obtain plates with variable thickness directly by rolling so as to prevent assembly steps and the associated technical and economic problems. Thickness variations would be possible in the longitudinal direction or the transverse direction (for example see R. Kopp, C. Wiedner and A. Meyer, International Sheet Metal Review, July/August 2005, p 20-24).

Furthermore, manufacturing of variable thickness plates has been envisaged by various methods, to solve other technical problems. Tailored blanks are also known in steelworks and provide a means of saving material during forming steps.

JP 11-192502 (Nippon Steel) describes a process for obtaining a steel blank for which the thickness and static mechanical characteristics vary across the width.

WO 00/21695 (Thyssen Krupp) describes a process for obtaining sections with a variable thickness along the rolling direction within a metallic blank, these sections having different mechanical properties.

Although it may be justified to save material, the modification in the geometry of plates has disadvantages in terms of fabrication, inspection and handling, and cannot provide a means for fast and direct transfer to existing processes used at aircraft manufacturers.

It is desired to develop an economical and controllable process for fabricating worked products and of monolithic structural elements made of an aluminium alloy, particularly for aeronautical construction, with usage properties that are variable within the element but having geometric characteristics identical to those of existing components. It is further desired to develop a process that varies the usage properties at various positions in the length of the structural elements but wherein the fabrication process does not require any artificial ageing.

SUMMARY OF THE INVENTION

One aspect of this invention is a process for fabricating a worked product or of a monolithic multi-functional structural element made of aluminium alloy comprising a hot working step, and at least one working step by cold plastic deformation after the hot working step, wherein generalized average plastic deformations are imposed in at least two zones of the structural element, and these imposed deformations are different by at least 2% or at least 3%.

Another aspect of the invention is a worked product or a structural element made of a 2XXX alloy in the T3X temper obtained by the process according to the invention.

Another aspect of the invention is a worked product a structural element made of a 2XXX alloy containing lithium in the T8X temper obtained by the process according to the invention.

DETAILED DESCRIPTION OF THE INVENTION

Figure 1:
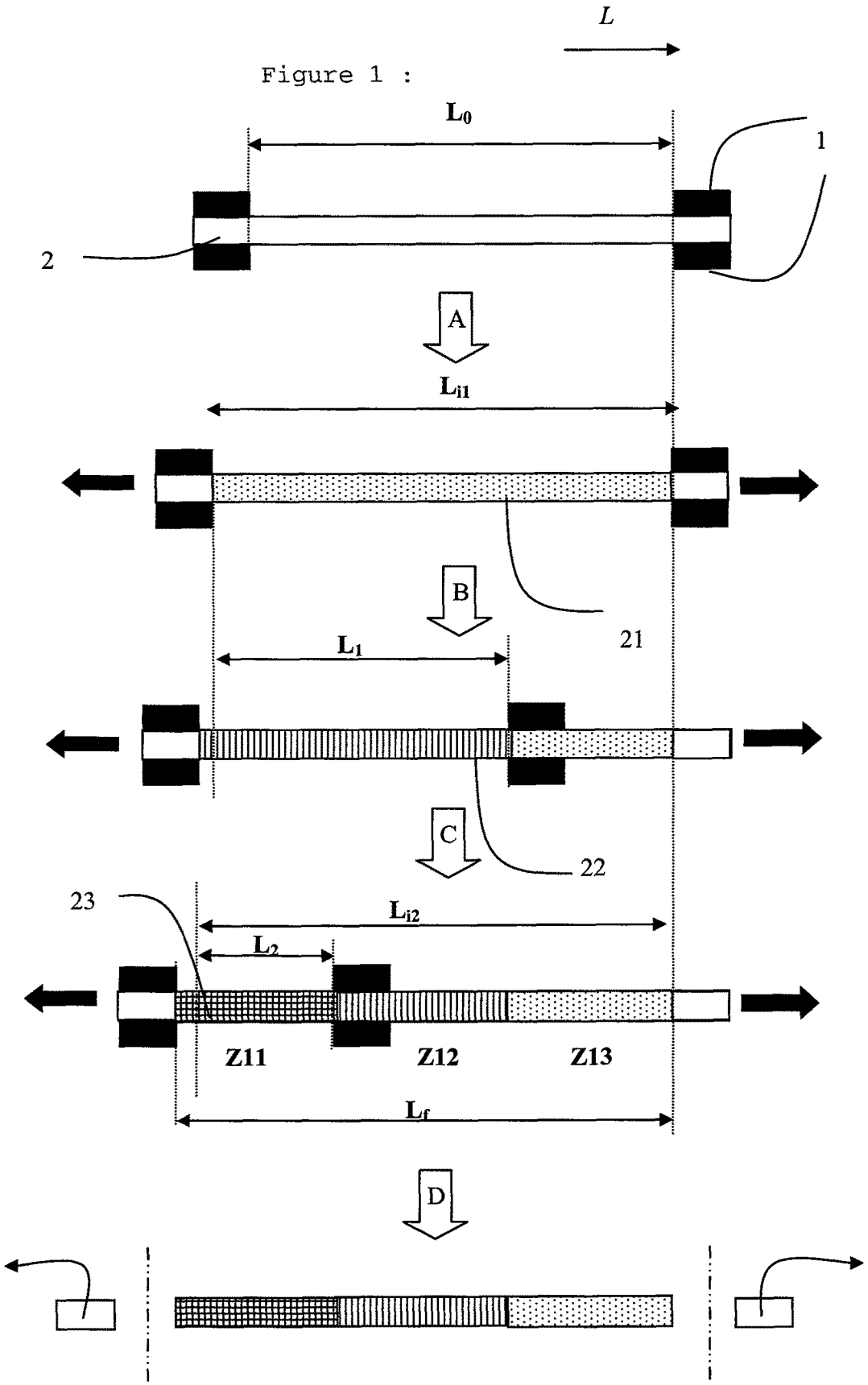
FIG. 1 diagrammatically shows an aspect of the invention in which three zones located at different positions along the L direction are subjected to different plastic deformations by controlled stretching applied by displacement of the jaws of the tension bench.

Aspects of the invention relate to worked products and structural components made of aluminium alloy, particularly for aeronautical construction. The worked products may be rolled products (such as thin structural plates, medium thickness plates, thick plates), extruded products (such as bars, sections, tubes or wires) and forged products.

Unless mentioned otherwise, the chemical composition of the alloys is expressed as a percent by mass. Consequently, in a mathematical expression, "0.4 Zn" means 0.4 times the content of zinc expressed in percent by mass; this is applicable mutatis mutandis to other chemical elements. Alloys are designated in accordance with the rules of The Aluminum Association known to those skilled in the art. Metallurgical tempers and heat treatments are defined in European standard EN 515. The chemical composition of normalized aluminium alloys is defined, for example, in standard EN 573-3. Unless mentioned otherwise, the static mechanical characteristics, in other words the ultimate strength $R_m$, the yield stress $R_{p0.2}$ and the elongation at failure A, are determined by a tensile test according to standard EN 10002-1, the location and direction at which test pieces are taken being defined in standard EN 485-1. The toughness $K_{IC}$ is measured according to standard ASTM E 399.

Unless mentioned otherwise, the definitions in European standard EN 12258-1 are applicable, and in particular an alloy with no heat treatment is an alloy that cannot be substantially hardened by a heat treatment and an alloy with a heat treatment is an alloy that can be hardened by an appropriate heat treatment.

The term "plate" is used in this description for all thicknesses of rolled products.

Cold plastic deformation in this description means a plastic deformation in which the metal is not deliberately heated either before being deformed or during deformation. There are several types of cold plastic deformations, particularly cold rolling, controlled stretching (flattening), wire drawing, drawing, die forging, die stamping, bending, compression and cold forging. By hot working step it is meant a working step wherein the initial metal temperature is at least 200° C.

The work-hardening ratio for rolling from a thickness $e_0$ to a thickness e is defined by $\tau(\%)=(e_0-e)/e$, and for stretching from a length $L_0$ to a length L is defined by $\tau(\%)=(L-L_0)/L_0$.

Generalized plastic deformation is known to those skilled in the art, and is defined for example in the manual "Mise en forme des métaux—Calculs sur la plasticité" (Forming of metals—Plasticity calculations) pages 24-25 by P. Baque, E. Felder, J. Hyafil and Y. D'Escatha published by Editions Dunod, Paris (1973) or in the book "Mise en forme des métaux et alliages" (forming of metals and alloys) pages 40-41 containing texts compiled by B. Baudelet, published by Editions du CNRS, 1976, Paris. Conventionally, the generalized deformation is a measurement of the deformation amplitude, and the deformation value $\bar{\varepsilon}$ used corresponds to a simple stretching test using the following criterion:

$$d\bar{\varepsilon} = \frac{\sqrt{2}}{3}[(d\varepsilon_1 - d\varepsilon_2)^2 + (d\varepsilon_2 - d\varepsilon_3)^2 + (d\varepsilon_3 - d\varepsilon_1)^2]^{1/2}$$

where $d\varepsilon_1$, $d\varepsilon_2$ and $d\varepsilon_3$ are the principal elementary deformations.

In the case of a plastic deformation, the volume variation is zero and therefore $d\varepsilon_1+d\varepsilon_2+d\varepsilon_3=0$. The generalized plastic deformation is additive for successive different steps of plastic deformation.

When rolling from a thickness $e_0$ to a thickness e in which the deformation is plane ($d_{\varepsilon 3}=0$, $d_{\varepsilon 2}=-d_{\varepsilon 1}$), the generalized plastic deformation is equal to $\varepsilon(\%)=(2/\sqrt{3})\ln(e_0/e)$.

In the case of stretching from a length $l_0$ to a length l, the generalized plastic deformation is equal to $\varepsilon(\%)=\ln(l/l_0)$.

For compression from a length $l_0$ to a length l, the generalized plastic deformation is equal to $\varepsilon(\%)=\ln(l_0/l)$.

The average generalized plastic deformation refers to the average of the generalized plastic deformation within a given volume.

The term "machining" includes any process for removal of material such as turning, milling, drilling, reaming, tapping, spark machining, grinding, polishing, chemical machining.

The term "extruded product" also includes products that have been drawn after extrusion, for example by cold extrusion through a die. It also includes hard drawn products.

The term "worked product" refers to a semi-finished product ready to be transformed, in particular by sawing, machining and/or forming into a structural element. In some cases, the worked product may be used directly as a structural element. Worked products may be rolled products (such as thin structural plates, medium thickness plates, thick plates), extruded products (such as bars, sections, tubes or wires) and forged products. When the fabrication process of the worked product comprises a stress relieving step by controlled stretching, the ends of the piece which were under the jaws of the tension bench are cut in order to make the piece suitable for mechanical construction.

The term "structural element" refers to an element used in a mechanical construction for which the static and/or dynamic mechanical characteristics are particularly important for performance and integrity of the structure, and for which a structural calculation is usually required or performed. It is typically a mechanical part, which if it fails will endanger the safety of the said construction, its users, passengers or others. For an aircraft, these structural elements include particularly elements making up the fuselage, such as the fuselage skin, stiffeners or stringers, bulkheads, circumferential frames, wings (such as the wing skin), stiffeners, ribs and spars, and the tail fin composed particularly of horizontal or vertical stabilisers, and floor beams, seat tracks and doors.

The term "monolithic structural element" refers to a structural element obtained from a single rolled, extruded, forged or cast partly finished product with no assembly such as riveting, welding, bonding with another part.

The term "multi-functional structural element" refers principally to the functions conferred by the metallurgical properties of the product and not by its geometric shape.

Aspects of the invention are directed to a process for fabricating a worked product or a structural element that comprises at least one cold plastic deformation step subsequent to the hot deformation step, wherein at least two zones of the worked product of the structural element are subjected to average generalized plastic deformations that differ by at least 2%, at least 3%, at least 4% or 5%. The zones considered have a significant volume compared with the total volume of the structural element. Advantageously, the volume of the zones considered represents at least 5%, at least 10% or at least 15% of the total volume of the worked product or of the structural element. Advantageously, every zone of the worked product or of the structural element undergo a minimal generalized plastic deformation of at least 1% or at least 1.5%

Advantageously, the process according to aspects of the invention comprises at least two working steps by cold plastic deformation subsequent to the hot working step.

The process leads to the production of worked products and of structural elements with a principal dimension or final length $L_f$ in the principal direction or length direction L and a final section equal to $S_f$ in the plane perpendicular to the principal direction. For example, the section $S_f$ is substantially constant at all points on the worked product. If the worked product is a plate with a final length $L_f$, final width $l_f$ and final thickness $e_f$, advantageously the thickness $e_f$ is substantially constant at all points. If it is an extruded product with length L and with a complex shape, advantageously the shape is identical at all points along the length.

Machining may be a final step in the process according to the invention to obtain a substantially constant final section and/or final thickness at all points of the worked product.

The process according to the invention can be used to produce worked products, and particularly plates or sections, and structural elements made of any wrought aluminium alloy. In particular, the invention may be used with alloys with no heat treatment such as the 1XXX, 3XXX, 5XXX alloys and some alloys in the 8XXX series, and particularly advantageously with 5XXX alloys containing scandium, particularly having a scandium content of 0.001 to 5% by weight or 0.01 to 0.3% by weight. The differences in the mechanical properties resulting from the differences in work-hardening obtained by the process according to the invention confer a multifunctional nature on structural elements made from worked products of an alloy with no heat treatment.

In an aspect of the invention, a heat treated aluminium alloy is used, and a solution heat treatment step and a quenching step are carried out between the hot working and the first working by cold plastic deformation, with an optional artificial ageing step subsequent to the working steps by cold plastic deformation. In particular, worked products and structural elements made of aluminium alloy in the 2XXX, 4XXX, 6XXX and 7XXX series, and a structurally hardened alloy in the 8XXX series containing lithium can be produced. By alloy containing lithium it is meant an alloy with a lithium content of at least 0.1 wt %. For alloys in the 2XXX series, artificial ageing can be used, for example, to obtain a T8X temper, or on the contrary, natural ageing to a T3X temper can be used. This aspect of invention is particularly advantageous for making worked products or structural elements made of 2XXX alloy in the T3X temper.

Aspect of the invention can be used to make worked products or structural elements made of a 2XXX alloy in the T3X temper containing at least two zones Z1 and Z2 with mechanical properties (measured at mid-thickness) selected from the group formed from (i) Z1: $R_m$(L)>500 MPa and particularly $R_m$(L)>520 MPa and Z2: A(L) (%)>16% and particularly A(L) (%)>18%

(ii) Z1: $R_m$(L)>450 MPa and particularly $R_m$(L)>470 MPa and Z2: A(L)(%)>18% and particularly A(L)(%)<20%

(iii) Z1: $R_m$(L)>550 MPa and particularly $R_m$(L)>590 MPa and Z2: A(L)(%)>10% and particularly A(L) (%)>14%

(iv) Z1: $R_m$(L)>550 MPa and particularly $R_m$(L)>590 MPa and Z2: $K_{1c}$(L-T)>45 MPa√m and particularly $K_{1c}$(L-T)>55 MPa√m.

Worked products or structural elements made of a 2XXX alloy in the T3X temper can also be obtained containing at least two zones Z1 and Z2 with physical and mechanical properties (measured at mid-thickness) in which:

(i) the difference in the $Rp_{0.2}$ values measured in the L direction or in the LT direction $R_p0.2$(Z1)−$R_p0.2$(Z2) is equal to at least 50 MPa and particularly at least 70 MPa and/or (ii) the difference in the Rm values measured in the L direction or in the LT direction $R_m$(Z1)−$R_m$(Z2) is equal to at least 20 MPa and particularly at least 30 MPa and/or (iii) the difference $K_{1c}$ measured in the L-T direction, $K_{1c}$(Z1)−$K_{1c}$(Z2), is equal to at least 5 MPa√m and particularly at least 15 MPa√m.

Aspect of the invention can also be used to obtain worked products or structural elements made of a 2XXX alloy containing lithium in the T8X temper containing at least two zones Z1 and Z2 with mechanical properties selected from the group formed from:

(i) Z1: $R_m$(L)>630 MPa and particularly $R_m$(L))>640 MPa and Z2: A(L) (%)>8% and particularly A(L)(%) >9%

(ii) Z1: $R_m$(L)>640 MPa and preferably $R_m$(L)>650 MPa and Z2: A(L) (%)>7% and particularly A(L) (%)<8%

(iii) Z1: $R_m$(L)>630 MPa and preferably $R_m$(L)>640 MPa and Z2 $K_{1c}$(L-T)>25 MPa√m and particularly $K_{1c}$(L-T)>30 MPa√m.

In the case of artificially aged alloys and in particular of alloys in the 7XXX series and of some alloys in the 2XXX series, cold plastic deformation done after the solution heat treatment and quenching steps can modify the artificial ageing rate. Thus, zones in which average generalized plastic deformations will reach different metallurgical tempers during artificial ageing giving the structural element its multi-functional nature. In one aspect of the invention applicable to all heat treated alloys subjected to artificial ageing, artificial ageing is done in a furnace with a temperature gradient so as to amplify property differences between the ends of the structural element.

In a first variant of the invention, the at least two zones of the worked product or of the structural element that are subjected to average generalized plastic deformations that are different by at least 2% are located in a different position along the principal or length direction L. In this case, the zones advantageously have a section $S_Z$ in the plane perpendicular to the direction L equal to the section of the worked product in this plane. In particular, when the section $S_f$ of the worked product is substantially constant, the section $S_Z$ is advantageously equal to substantially $S_f$. In this first variant, the length of the said zones along the L direction is for example equal to at least 1 m or to at least 5 m.

Advantageously, a first variant of the process according to the invention includes at least one cold plastic deformation step by controlled stretching. Controlled stretching is normally used to flatten or straighten and to reduce residual stresses. In one aspect of the invention, a controlled stretching step is performed in which one of the ends of the intermediate product on which the controlled stretching is carried out projects significantly beyond the jaws of the tension bench, and can also be used to generate average generalized plastic deformations that are different in two zones of the structural element.

FIG. 1 illustrates one aspect of the invention in which three controlled stretching steps are carried out one after the other. The intermediate product (2) with useful initial length (in other words length between jaws) equal to $L_0$ is stretched as a whole in a first step A, to flatten it and/or to straighten it. It thus reaches a first useful intermediate length $L_{il}$ and the average generalized passive deformation is equal to $\varepsilon_l(\%)=(\ln(L_{il}/L_0)$ for part (21) located between the jaws of the piece (2). At least one of the jaws (1) of the tension bench is then displaced as shown on FIG. 1, such that one of the ends of the piece projects significantly beyond the jaws and that the length of the piece between the jaws is equal to $L_1$. A second controlled stretching step B is then carried out on the zone of the structural element located between the jaws so as to obtain a second useful intermediate length $L_{i2}$ of the element and therefore to change the zone (22) between the jaws from length $L_1$ to length $L_{i2}-L_{i1}+L_1$. Therefore, during the second step, the average generalized deformation of this zone is equal to $\varepsilon_2(\%)=\ln((L_{i1}-L_{i1}+L_1)/L_1)$. Optionally, at least one of the jaws may be displaced again so as to perform at least one third stretching step C over a portion with length $L_2$. In the case shown diagrammatically on FIG. 1, this third step results in a final useful length $L_f$ and the length of the zone (23) located between the jaws is increased by $L_f-L_{i2}$ and therefore is subjected to an average generalized deformation during this third step equal to $\varepsilon_3(\%)=l_N((L_f-L_{i2}+L_2/L_2)$. In a fourth step D, the ends of the piece which were under the jaws of the traction bench during step A are cut. In the case illustrated in FIG. 1, the four deformation steps thus define three zones Z11, Z12 and Z13 of the worked product for which the average generalized plastic deformation is equal to $\varepsilon_{11}=\varepsilon_1$, $\varepsilon_{12}=\varepsilon_1+\varepsilon_2$ and $\varepsilon_{13}=\varepsilon_1+\varepsilon_2+\varepsilon_3$ respectively. The operation can be repeated as many times as necessary so as to obtain a difference in the average generalized plastic deformation equal to at least 2% between at least two zones located at a different position in the principal direction L.

The process using successive stretching steps described in FIG. 1 may be applied to plates or to extruded products.

Figure 2:
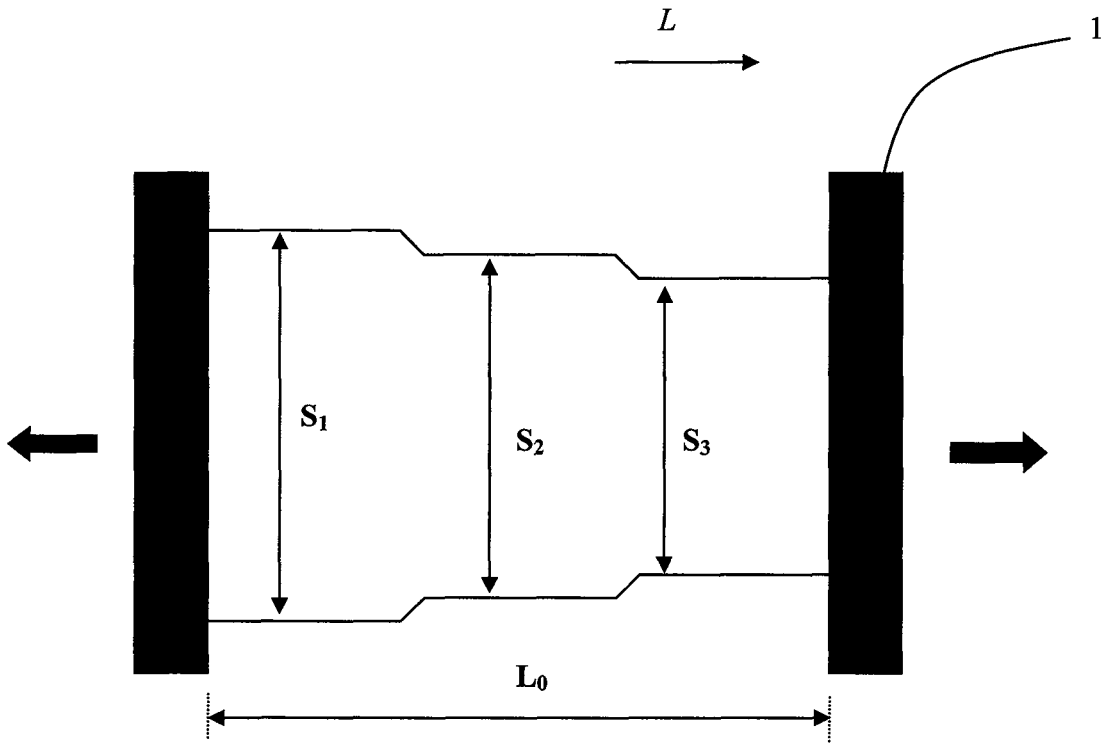
FIG. 2 diagrammatically shows an aspect of the invention in which three zones located at different positions along the L direction are subjected to different plastic deformations by controlled stretching applied by a variation of the section.

FIG. 2 describes another aspect of the first variant of the invention. In this aspect, an intermediate product with a variable cross-section along the direction of the length L is produced by shearing, trimming, machining or any other appropriate method. In FIG. 2, the initial length of the intermediate product obtained is $L_0$ and the cross-sections of the three zones $S_1$, $S_2$ and $S_3$ are different. Deformations in these zones during the stretching step of this intermediate product are different.

Figure 5:
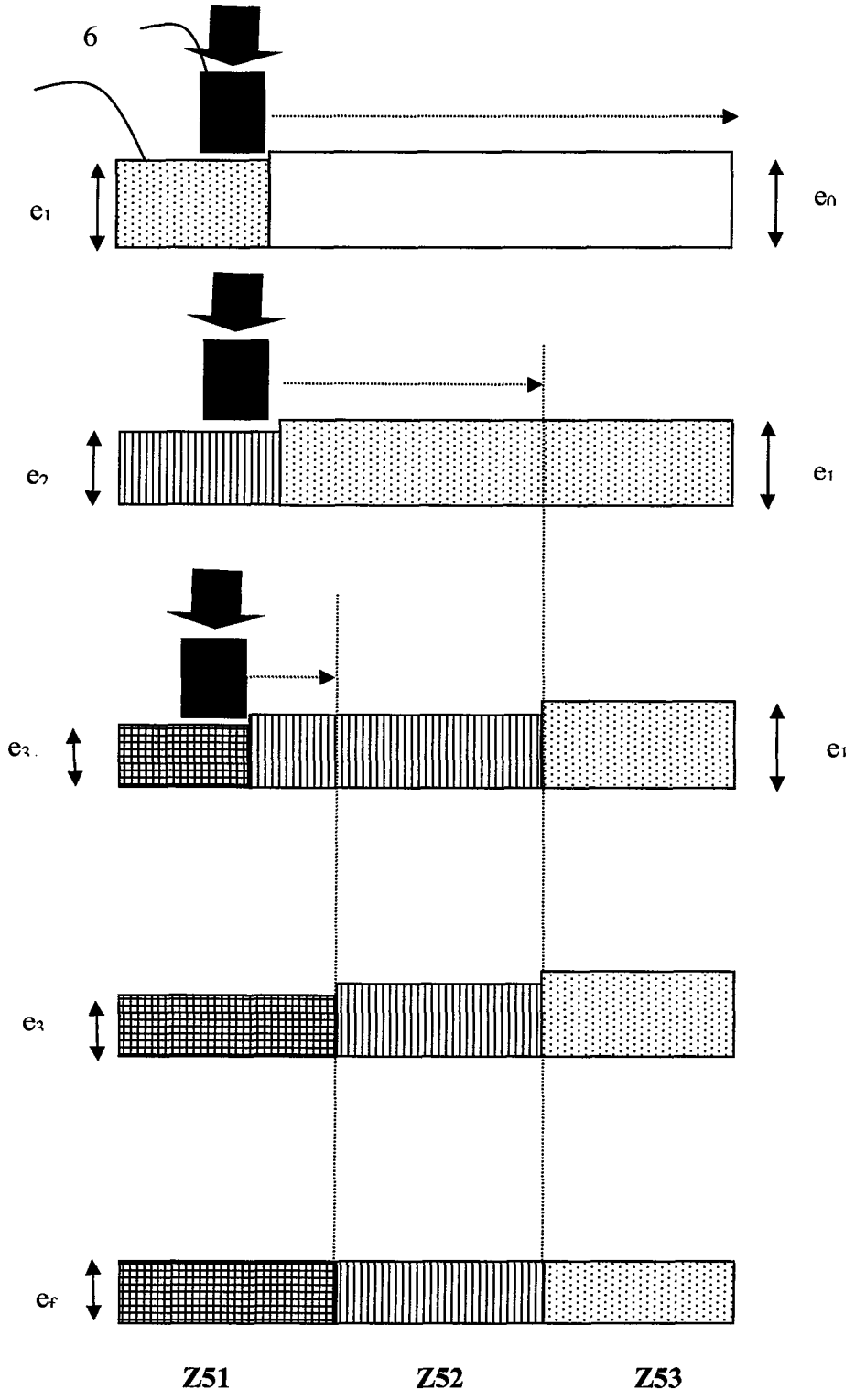
FIG. 5 diagrammatically shows an aspect of the invention in which three zones located at different positions are subjected to different plastic deformations by compression.

In another aspect of the invention generally applicable to manufacturing of plates, at least one cold plastic deformation step is made by compression. This aspect is illustrated in FIG. 5.

Figure 3:
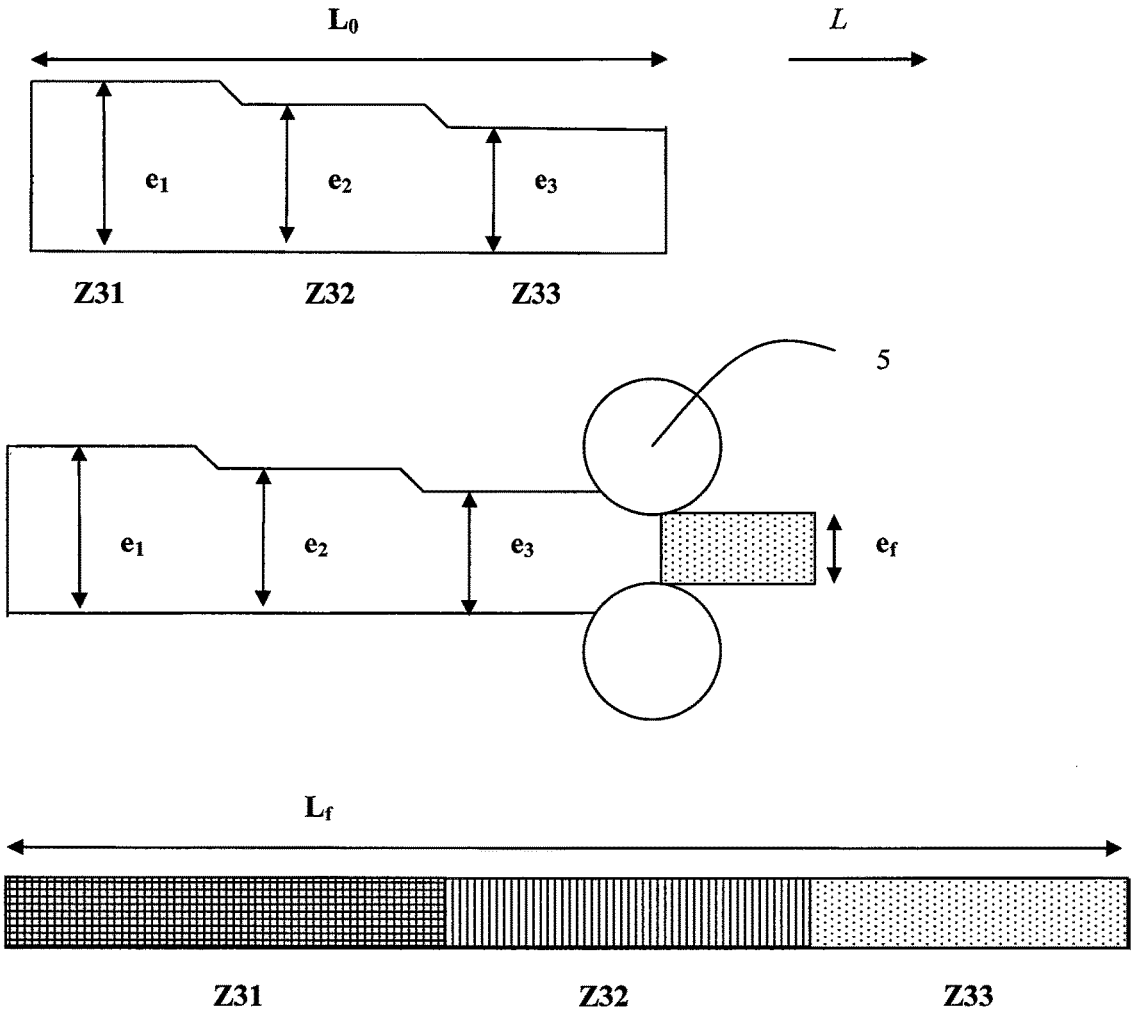
FIG. 3 diagrammatically shows an aspect of the invention in which three zones located at different positions along the L direction are subjected to different plastic deformations by cold rolling due to a variation of the thickness before rolling.

In yet another aspect of the first variant of the invention applicable only to manufacturing of plates, the process according to the invention includes a cold rolling step in which the plate thickness is variable at the entry to the rolling mill and is substantially constant at the exit from the rolling mill. FIG. 3 illustrates an aspect in which a plate with three zones Z31, Z32 and Z33 with thicknesses $e_1$, $e_2$ and $e_3$ respectively and an initial length $L_0$ is subjected to a cold rolling step between two cylinders (5) leading to a final thickness $e_f$. The average generalized plastic deformations in the different zones Z31, Z32 and Z33 are $\varepsilon_{31}(\%)=(2\sqrt{3})\ln(e_1/e_f)$, $\varepsilon_{32}(\%)=(2\sqrt{3})\ln(e_2/e_f)$ and $\varepsilon_{33}(\%)=(2\sqrt{3})\ln(e_3/e_f)$ respectively.

The plate with variable thickness along the L direction necessary in the aspect described in FIG. 3 can for example be obtained by modifying the target thickness during hot rolling. In another aspect, this plate with variable thickness may be obtained by machining a constant thickness plate output from the hot rolling step. FIG. 3 describes an aspect in which the thickness is varied on a single face, the other face remaining plane. The thickness can also be varied on the two faces without either of the faces being kept plane.

In yet another aspect of the first variant of the invention that is only applicable to manufacturing of plates, the process according to the invention includes a cold rolling step in which the plate thickness is substantially constant at the entry to the rolling mill and is variable in the direction L at the exit from the rolling mill and a subsequent machining step to obtain an substantially constant thickness at all points.

In a second variant of the invention suitable for manufacturing of plates with a principal direction or length along the L direction, a transverse dimension or width in the direction l and a thickness dimension in the direction e, the zones in the structural element subjected to average generalized plastic deformations different by at least 2% are located at a different position along the transverse direction l. In this case, the zones advantageously have a thickness $e_z$ in the direction of the thickness e equal to the thickness of the worked product. In particular, when the thickness $e_f$ of the worked product is substantially constant, the thickness $e_z$ is advantageously equal to substantially $e_f$.

In this second variant, the width of the said zones is for example equal to at least 0.2 m or at least 0.4 m.

Figure 4:
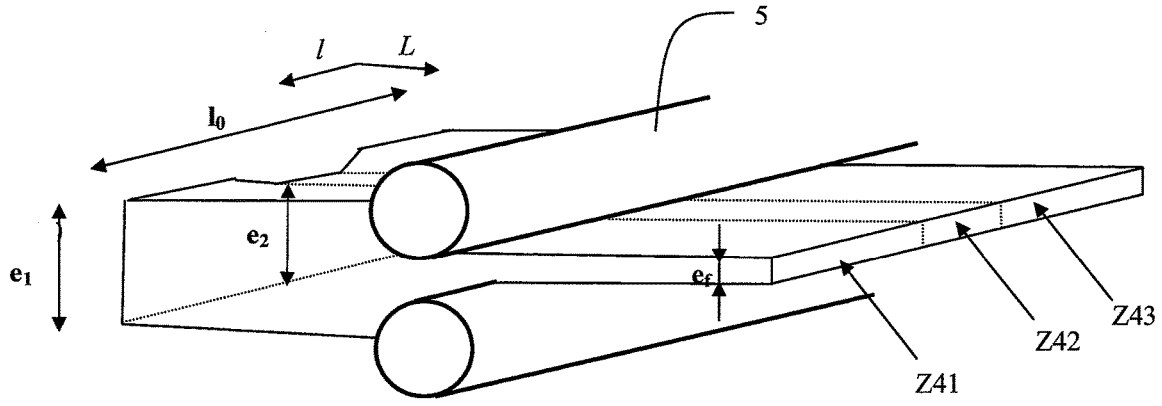
FIG. 4 diagrammatically shows an aspect of the invention in which three zones located at different positions along the l direction are subjected to different plastic deformations by cold rolling due to a variation of the thickness before rolling.

In one aspect of this second variant, the process according to invention includes a cold rolling step in which the plate thickness is variable along the transverse direction l at the entry to the rolling mill and is substantially constant at the exit from the rolling mill. The variation in the thickness of the plate may be obtained particularly by hot rolling, machining after hot rolling or forging. This aspect is illustrated on FIG. 4, in which a plate with a thickness of $e_1$ for zones located at the ends of the element in the direction l, and $e_2$ for the zone located at the centre along the direction l, is rolled along the L direction to an substantially uniform thickness $e_f$. The average generalized plastic deformations applied to the different zones Z41, Z42 and Z43 are equal to $\varepsilon_{41}(\%)=(2\sqrt{3})\ln(e_1/e_f)$, $\varepsilon_{42}(\%)=(2\sqrt{3})\ln(e_2/e_f)$ and $\varepsilon_{43}(\%)=\varepsilon_{41}(\%)=(2\sqrt{3})\ln(e_3/e_f)$ respectively. The aspect in which the Z41 and Z43 zones have the same initial thickness is advantageous, however an aspect in which the thicknesses are different could also be envisaged.

In yet another aspect of the second variant of the invention that is only applicable to manufacturing of plates, the process according to the invention includes a cold rolling step in which the thickness of the plate is substantially constant at the entry to the rolling mill and is variable in the direction l at the exit from the rolling mill, and a subsequent machining step to obtain an substantially constant thickness at all points.

FIG. 5 describes another aspect in which compression is applied using a tool (6) that is displaced in the direction symbolised by an arrow. The thickness is reduced from $e_0$ to $e_1$ during a first step, and then from $e_1$ to $e_2$ over part of the structural element during a second step, and finally from $e_2$ to $e_3$ during a third step, defining three zones Z51, Z52 and Z53. A final machining step results in an substantially equal final thickness $e_f$ at all points. The plate can also be machined to different thicknesses and then compressed so as to obtain a constant thickness at all points.

EXAMPLE 1

A 25 mm thick plate with variable properties within the plate is made of an AA2023 alloy.

A 30 meter long, 2.5 meter wide and 28.2 mm thick plate is made by hot rolling of a rolling ingot.

The composition of the alloy used is given in Table 1 below.

TABLE 1

Composition of the rolling ingot made of AA2023 alloy (% by mass)

| Si | Fe | Cu | Mg | Ti | Zr | Sc |
|---|---|---|---|---|---|---|
| 0.06 | 0.07 | 3.81 | 1.36 | 0.024 | 0.11 | 0.03 |

The rolling ingot is homogenized at 500° C. for 12 hours. The hot rolling entry temperature is 460° C.

After hot rolling, the plate is machined as shown on FIG. 3 to obtain three zones Z31, Z32, Z33, with a length equal to 10 meters with the following thicknesses:

zone Z31: 28.1 m zone Z32: 26.3 m zone Z33: 25.5 m

The plate is then solution heat treated at 500° C. and quenched.

The plate is first cold rolled to obtain a substantially constant thickness of 25.5 mm over the entire plate, and then subjected to controlled stretching with a permanent elongation of about 2%, after which the ends of the piece which were under the jaws of the tension bench are cut off.

The rolling step changes the length of zone Z31 to about 11 meters.

Deformations in the different zones are summarized in Table 2 below:

TABLE 2

Work-hardening and generalized deformation ratios in zones Z31, Z32 and Z33

| Zone | Work-hardening ratio by rolling | Work-hardening ratio by stretching | Total work-hardening ratio | Generalized deformation by rolling | Generalized deformation by stretching | Total generalized deformation |
|---|---|---|---|---|---|---|
| Z31 | 10.2% | 2.0% | 12.4% | 11.2% | 2.0% | 13.2% |
| Z32 | 3.1% | 2.0% | 5.2% | 3.6% | 2.0% | 5.6% |
| Z33 | 0.0% | 2.0% | 2.0% | 0.0% | 2.0% | 2.0% |

Samples are taken from zones Z31, Z32 and Z33. The results of the mechanical tests are given in table 3 below:

TABLE 3

Results of mechanical tests performed in zones Z31, Z32 and Z33

| | L direction | | | LT direction | | |
|---|---|---|---|---|---|---|
| Zone | $R_m$ (MPa) | $R_{p0.2}$ (MPa) | A (%) | $R_m$ (MPa) | $R_{p0.2}$ (MPa) | A (%) |
| Z31 | 533 | 464 | 12.3 | 499 | 414 | 17.0 |
| Z32 | 509 | 422 | 17.0 | 468 | 364 | 22.4 |
| Z33 | 504 | 388 | 20.6 | 465 | 335 | 24.1 |

The process according to the invention results in compromises of different properties in zones Z31, Z32 and Z33. Thus, zone Z31 is characterized by high strength at the detriment of a limited elongation while zone Z33 is distinguished by high elongation with lower static mechanical strength.

EXAMPLE 2

A 15 mm thick plate with variable properties is made of an AA2024A alloy.

A 30 meter long, 2.5 meter wide and 16.8 mm thick plate is made by hot rolling of a rolling ingot.

The composition of the alloy used is given in Table 4 below.

TABLE 4

Composition of the rolling ingot made of AA2024A alloy (% by mass)

| Si | Fe | Cu | Mn | Mg | Ti |
|---|---|---|---|---|---|
| 0.04 | 0.07 | 3.96 | 0.38 | 1.29 | 0.013 |

The rolling ingot is homogenized and then hot rolled.

After hot rolling, the plate is machined as described in FIG. 3 to obtain three zones Z31, Z32 and Z33 with a length equal to 10 meters with the following thicknesses:

Zone Z31: 16.7 mm

Zone Z32: 15.9 mm

Zone Z33: 15.3 mm

The plate is then solution heat treated at 500° C. and quenched.

The plate is first cold rolled to obtain a substantially constant thickness of 15.3 mm over the entire plate, and then subjected to controlled stretching with a permanent elongation of about 2% after which the ends of the piece which were under the jaws of the tension bench are cut off.

The length of zone Z31 after the rolling step is equal to substantially 10.9 meters.

Deformations in the different zones are summarized in Table 5 below:

TABLE 5

Work-hardening and generalized deformation ratios in zones Z31, Z32 and Z33

| Zone | Work-hardening ratio by rolling | Work-hardening ratio by stretching | Total work-hardening ratio | Generalized deformation by rolling | Generalized deformation by stretching | Total generalized deformation |
|---|---|---|---|---|---|---|
| Z31 | 0.2% | 2% | 11.3% | 10.1% | 2.0% | 12.1% |
| Z32 | 3.9% | 2% | 6.0% | 4.4% | 2.0% | 6.4% |
| Z33 | 0.0% | 2% | 2.0% | 0.0% | 2.0% | 2.0% |

Samples are taken from zones Z31, Z32 and Z33. The results of the mechanical tests are given in Table 6 below:

TABLE 6

Results of mechanical tests performed in zones Z31, Z32 and Z33

| | L direction | | | LT direction | | |
|---|---|---|---|---|---|---|
| Zone | $R_m$ (MPa) | $R_{p0.2}$ (MPa) | A (%) | $R_m$ (MPa) | $R_{p0.2}$ (MPa) | A (%) |
| Z31 | 477 | 437 | 16.8 | 495 | 416 | 13.0 |
| Z32 | 467 | 414 | 17.9 | 481 | 390 | 15.6 |
| Z33 | 444 | 360 | 23.4 | 467 | 337 | 18.5 |

The process according to the invention results in compromises of different properties in zones Z31, Z32 and Z33. Thus, zone Z31 is characterized by high strength at the detriment of a limited elongation while zone Z33 is distinguished by high elongation with lower static strength.

EXAMPLE 3

A section with variable properties with a 170×45 mm cross-section is made of a AA2027 alloy.

A 15 meter long section is made with a 170×45 mm cross-section, by hot extrusion of an extrusion billet.

The composition of the alloy is given in Table 7 below:

TABLE 7

Composition of the rolling ingot made of AA2027 alloy (% by mass)

| Si | Fe | Cu | Mn | Mg | Zn | Ti | Zr |
|---|---|---|---|---|---|---|---|
| 0.05 | 0.11 | 4.2 | 0.6 | 1.3 | 0.06 | 0.02 | 0.11 |

The extrusion billet is homogenized at 490° C. and hot extruded.

After extrusion, the section is solution heat treated at 500° C. and quenched.

A first controlled stretching step is then carried out on it with the permanent elongation of 2.8%. One of the jaws of the tension bench is then displaced as shown on FIG. 1, so that one of the ends of the section projects beyond the jaws. A second stretching step is then carried out on the two-thirds of the section (zones Z11 and Z12) located between the jaws with a permanent elongation of 5.6%. The jaw displaced in the second step is then displaced again such that one third of the section (zone Z11) is located between the jaws. A third stretching step is then carried out with a permanent elongation of 2.4%. The ends of the piece which were under the jaws of the tension bench during the first stretching step are then cut off. The result is a section with three zones $Z_{11}$, $Z_{12}$ and $Z_{13}$ with substantially equal lengths and with different stretching deformations.

The deformations in the zones are summarized in Table 8 below:

TABLE 8

Work-hardening and generalized deformation ratios in zones Z11, Z12 and Z13

| | Work-hardening ratio by stretching | | | | Generalized deformation ratio | | | |
|---|---|---|---|---|---|---|---|---|
| Zone | Step 1 | Step 2 | Step 3 | Total | Step 1 | Step 2 | Step 3 | Total |
| Z11 | 2.8% | 5.6% | 2.4% | 11.2% | 2.8% | 5.4% | 2.4% | 10.6% |
| Z12 | 2.8% | 5.6% | | 8.6% | 2.8% | 5.4% | | 8.2% |
| Z13 | 2.8% | | | 2.8% | 2.8% | | | |

Samples are taken in zones Z11, Z12 and Z13. The results of the mechanical tests are given in Table 9 below:

TABLE 9

Results of mechanical tests carried out in zones Z11, Z12 and Z13

| | L direction | | | $K_{Ic}$(MPa√m) | |
|---|---|---|---|---|---|
| Zone | $R_m$ (MPa) | $R_{p0.2}$ (MPa) | A % | L-T | T-L |
| Z11 | 606 | 585 | 6.1 | 45.9 | 31.5 |
| Z12 | 554 | 503 | 9.9 | 47.7 | 33.5 |
| Z13 | 554 | 443 | 15.8 | 64.0 | 49.7 |

The process according to the invention results in compromises with different properties in zones Z11, Z12 and Z13. Thus, zone Z11 is characterized by high mechanical strength to the detriment of limited elongation and limited toughness, while zone Z13 is distinguished by a high elongation and high toughness but for a relatively low static mechanical strength.

EXAMPLE 4

A 30 mm thick plate with variable properties is made of an AA2195 alloy.

A 30 meter long, 2.5 meter wide and 33 mm thick plate is made by hot rolling of a rolling ingot.

The composition of the alloy is given in Table 10 below:

TABLE 10

| Composition of the rolling ingot made of AA2195 alloy (% by mass) | | | | | | |
|---|---|---|---|---|---|---|
| Si | Fe | Cu | Li | Mg | Zr | Ag |
| 0.03 | 0.06 | 4.3 | 1.17 | 0.39 | 0.12 | 0.35 |

The rolling ingot is homogenized and then hot rolled. The plate is then solution heat treated at 510° C. and quenched.

Half of the plate (zone G) is then cold rolled to a thickness of 30 mm while the other half is subjected to controlled stretching of 2.5% (zone H).

The plate is first machined to obtain a substantially constant thickness of 30 mm over the entire plate, and then subjected to controlled stretching with a permanent elongation of about 1.5% after which the ends of the piece which were under the jaws of the tension bench are cut off.

The deformations in the different zones are summarized in Table 11 below:

TABLE 11

| Work-hardening and generalized deformation ratios in zones G and H. | | | | | | |
|---|---|---|---|---|---|---|
| Zone Zone | Work-hardening ratio by rolling | Work-hardening ratio by stretching | Total work-hardening ratio | Generalized deformation by rolling | Generalized deformation by stretching | Total generalized deformation |
| G | 10% | 1.5% | 11.3% | 11% | 1.5% | 11.5% |
| H | 0% | 2.5 + 1.5% | 4.0% | 0% | 2.5 + 1.5% | 4.0% |

Samples are taken from zones G and H. The results of the mechanical test are given in table 12 below:

TABLE 12

| Results of mechanical tests carried out in zones G and H | | | | |
|---|---|---|---|---|
| | L direction | | | |
| Zone | Rm (MPa) | Rp0.2 (MPa) | A % | $K_{1c}$(L-T) (MPa√m) |
| G | 642 | 631 | 7.7 | 25.2 |
| H | 628 | 600 | 8.9 | 32.0 |

The process according to the invention results in compromises of different properties in zones G and H. Thus, zone G is characterized by high strength at the detriment of limited elongation and limited toughness while zone H is distinguished by higher elongation and toughness with lower static strength.

The invention claimed is:

1. Worked product consisting of a 2XXX alloy in the T3X temper prepared by a hot working step, and at least one working step by cold plastic deformation after the hot working step, wherein at least two zones of said worked product have imposed generalized average plastic deformations, wherein the imposed deformations are different by at least 2%; wherein said at least two zones Z1 and Z2 have mechanical properties selected from the group consisting of (i) Z1: $R_m$(L)>500 MPa and Z2: A(L)(%)>16%

(ii) Z1: $R_m$(L)>450 MPa and Z2: A(L)(%)>18%

(iii) Z1: $R_m$(L)>550 MPa and Z2: A(L)(%)>10%

(iv) Z1: $R_m$(L)>550 MPa and Z2: $K_{1c}$(L-T)>45 MPa√m; and wherein the worked product consisting of a 2XXX alloy in the T3X temper is naturally aged.

2. Worked product consisting of a 2XXX alloy in the T3X temper prepared by a hot working step, and at least one working step by cold plastic deformation after the hot working step, wherein at least two zones of said worked product have imposed generalized average plastic deformations, wherein the imposed deformations are different by at least 2%; wherein at least two zones Z1 and Z2 have mechanical properties wherein at least one of the following is satisfied (i) the difference in the $Rp_{0.2}$ values measured in the L direction or in the LT direction $R_p0.2$(Z1)−$R_p0.2$(Z2) is equal to at least 50 MPa (ii) the difference in the Rm values measured in the L direction or in the LT direction $R_m$(Z1)−$R_m$(Z2) is equal to at least 20 MPa (iii) the difference $K_{1c}$ measured in the L-T direction, $K_{1c}$(Z1)−$K_{1c}$(Z2), is equal to at least 5 MPa√m; and wherein the worked product consisting of a 2XXX alloy in the T3X temper is naturally aged.

3. Worked product consisting of a 2XXX alloy containing lithium in the T8X temper prepared by a hot working step, and at least one working step by cold plastic deformation after the hot working step, wherein at least two zones of said worked product have imposed generalized average plastic deformations, wherein the imposed deformations are different by at least 2%; wherein at least two zones Z1 and Z2 have mechanical properties selected from the group consisting of (i) Z1: $R_m$(L)>630 MPa and Z2: A(L)(%)>8%

(ii) Z1: $R_m$(L)>640 MPa and Z2: A(L)(%)>7%

(iii) Z1: $R_m$(L)>630 MPa and Z2 $K_{1c}$(L-T)>25 MPa√m.

4. Structural elements made of a 2XXX alloy in the T3X temper comprising the worked product of claim 1.

5. Structural element made of a 2XXX alloy in the T3X temper comprising the worked product of claim 2.

6. Structural element made of a 2XXX alloy containing lithium in the T8X temper comprising the worked product of claim 3.

7. Worked product according to claim 1 wherein (i) Z1: $R_m$(L)>520 MPa and Z2: A(L)(%)>18%

(ii) Z1: $R_m$(L)>470 MPa and Z2: A(L)(%)>20%

(iii) Z1: $R_m$(L)>590 MPa and Z2: A(L)(%)>14%

(iv) Z1: $R_m$(L)>590 MPa and Z2: $K_{1c}$(L-T)>55 MPa√m.

8. Worked product according to claim 2

(i) the difference in the $Rp_{0.2}$ values measured in the L direction or in the LT direction $R_p0.2(Z1)-R_p0.2(Z2)$ is equal to at least 70 MPa (ii) the difference in the Rm values measured in the L direction or in the LT direction $R_m(Z1)-R_m(Z2)$ is equal to at least 30 MPa (iii) the difference $K_{1c}$ measured in the L-T direction, $K_{1c}(Z1)-K_{1c}(Z2)$, is equal to at least 15 MPa√m.

9. Worked product according to claim 2 wherein (i) Z1: $R_m(L)>630$ MPa and Z2: A(L)(%)>8%

(ii) Z1: $R_m(L)>640$ MPa and Z2: A(L)(%)>7%

(iii) Z1: $R_m(L)>630$ MPa and Z2 $K_{1c}(L\text{-}T)>25$ MPa√m.

10. Structural elements according to claim 4 wherein (i) Z1: $R_m(L)>520$ MPa and Z2: A(L)(%)>18%

(ii) Z1: $R_m(L)>470$ MPa and Z2: A(L)(%)>20%

(iii) Z1: $R_m(L)>590$ MPa and Z2: A(L)(%)>14%

(iv) Z1: $R_m(L)>590$ MPa and Z2: $K_{1c}(L\text{-}T)>55$ MPa√m.

11. Structural element according to claim 5 wherein (i) the difference in the $Rp_{0.2}$ values measured in the L direction or in the LT direction $R_p0.2(Z1)-R_p0.2(Z2)$ is equal to at least 70 MPa (ii) the difference in the Rm values measured in the L direction or in the LT direction $R_m(Z1)-R_m(Z2)$ is equal to at least 30 MPa (iii) the difference $K_{1c}$ measured in the L-T direction, $K_{1c}(Z1)-K_{1c}(Z2)$, is equal to at least 15 MPa√m.

12. Structural element according to claim 6 wherein (i) Z1: $R_m(L)>640$ MPa and Z2: A(L)(%)>9%

(ii) Z1: $R_m(L)>650$ MPa and Z2: A(L)(%)>8%

(iii) Z1: $R_m(L)>640$ MPa and Z2: $K_{1c}(L\text{-}T)>30$ MPa√m.

13. Worked product according to claim 1, wherein the imposed deformations are different by at least 3%.

14. Worked product according to claim 2, wherein the imposed deformations are different by at least 3%.

15. Worked product according to claim 3, wherein the imposed deformations are different by at least 3%.

16. Worked product according to claim 1, wherein the 2XXX alloy comprises from about 3.81 to about 4.3 weight percent copper and from about 0.39 to about 1.36 weight percent magnesium.

17. Worked product according to claim 2, wherein the 2XXX alloy comprises from about 3.81 to about 4.3 weight percent copper and from about 0.39 to about 1.36 weight percent magnesium.

18. Worked product according to claim 3, wherein the 2XXX alloy comprises from about 3.81 to about 4.3 weight percent copper and from about 0.39 to about 1.36 weight percent magnesium.

19. Worked product according to claim 1, wherein the 2XXX alloy comprises AA2195.

* * * * *